US008526874B2

(12) United States Patent
Inoue

(10) Patent No.: US 8,526,874 B2
(45) Date of Patent: Sep. 3, 2013

(54) IMAGE FORMING APPARATUS

(75) Inventor: Masafumi Inoue, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 738 days.

(21) Appl. No.: 12/641,555

(22) Filed: Dec. 18, 2009

(65) Prior Publication Data

US 2010/0158596 A1 Jun. 24, 2010

(30) Foreign Application Priority Data

Dec. 22, 2008 (JP) ..... 2008-325132

(51) Int. Cl.
*G03G 15/00* (2006.01)

(52) U.S. Cl.
USPC ..... 399/401; 399/364; 399/373

(58) Field of Classification Search
USPC ..... 399/401, 364, 373
See application file for complete search history.

(56) References Cited

U.S. PATENT DOCUMENTS

| | | | | |
|---|---|---|---|---|
| 6,032,949 | A * | 3/2000 | Ando | 271/225 |
| 2003/0234155 | A1* | 12/2003 | Kanamori et al. | 198/394 |
| 2005/0035539 | A1* | 2/2005 | Hashimoto | 271/265.01 |
| 2007/0092320 | A1* | 4/2007 | Taniguchi et al. | 399/381 |
| 2008/0141923 | A1* | 6/2008 | Hawkes | 114/338 |

FOREIGN PATENT DOCUMENTS

| | | | |
|---|---|---|---|
| JP | 09-290941 | A | 11/1997 |
| JP | 2000-38235 | A | 2/2000 |
| JP | 2002-096944 | | 4/2002 |
| JP | 2002-302293 | | 10/2002 |
| JP | 2004-50663 | A | 2/2004 |
| JP | 2008-184259 | | 8/2008 |

OTHER PUBLICATIONS

Notice of Reasons for Rejection dated Sep. 7, 2010 in Japanese Application No. 2008-325132 and English translation thereof.

* cited by examiner

*Primary Examiner* — Matthew G Marini
*Assistant Examiner* — Allister Primo
(74) *Attorney, Agent, or Firm* — Banner & Witcoff, Ltd.

(57) ABSTRACT

A transmission mechanism of an image forming apparatus includes: a first transmitting section transmitting a driving force of a drive mechanism to a first transporting roller; and a second transmitting section transmitting the driving force of the first transmitting section to a second transporting roller. The first transmitting section has a first gear rotatable integrally with the first transporting roller. The second transmitting section has a second gear engaged with the first gear; a shaft extended in a direction intersecting the rotational axes of the first and second transporting rollers, and rotatable integrally with the second gear; a third gear rotatable integrally with the shaft; and a fourth gear engaged with the third gear and rotatable integrally with the second transporting roller. The image forming apparatus is capable of transporting a paper favorably along a re-transporting path.

16 Claims, 12 Drawing Sheets

IMAGE FORMING APPARATUS

CROSS REFERENCE TO RELATED APPLICATION

The present application claims priority from Japanese Patent Application No. 2008-325132, filed on Dec. 22, 2008, the disclosure of which are incorporated herein by reference in their entirety.

BACKGROUND OF THE INVENTION

1. Field of the Invention

The present invention relates to an image forming apparatus.

2. Description of the Related Art

A conventional image forming apparatus has been disclosed in Japanese Patent Application Laid-open No. 2002-302293. The image forming apparatus includes an image forming section which forms an image on a paper which is transported, a paper reverse section which turns over a paper which has passed through the image forming section, and a re-transporting section which re-transports the paper which has been turned over in the paper reverse section, to the image forming section along a re-transporting path.

The re-transporting section includes a motor as a driving mechanism which generates a driving force; a first transporting roller which transports the paper; a plurality of second transporting rollers which are positioned at an upstream side of the re-transporting path with respect to the first transporting roller, and which transport the paper together with the first transporting roller; and a transmission mechanism which transmits the driving force of the motor to the first transporting roller and the second transporting rollers.

The transmission mechanism includes a set of a belt and a pulley as a first transmitting section which transmits the driving force of the motor to the first transporting roller; and a plurality of sets of belts and pulleys as a second transmitting section which transmits the driving force of the first transmitting section to the second transporting rollers. As a belt and a pulley, for eliminating transmission loss due to slippage, generally, a timing belt and a pulley are used. The timing belt has a large number of projections formed on an outer peripheral surface thereof and lined up in a direction of circulation, and a pulley has grooves which engage with the projections of the timing belt.

In the conventional image forming apparatus having above described structure, the paper, which is turned over by the paper reverse section and the re-transporting section, is transported once again to the image forming section along the re-transporting path. In the re-transporting section, the driving force of the motor is transmitted to the first transporting roller and the second transporting rollers by the belts and the pulleys.

SUMMARY OF THE INVENTION

Incidentally, in the conventional image forming apparatus, when an appropriate tension is not imparted to the timing belt at the time of assembling, or, when the tension in the timing belt is reduced due to deterioration, there may occur tooth-skipping between the timing belt and the grooved pulley. Moreover, due to repetitive deformation of the timing belt, a crack may be developed around the projection, and the projection may be defective. When such defect is developed, the driving force of the motor is not transmitted appropriately to the first transporting roller and the second transporting rollers, and it becomes difficult to transport the paper favorably along the re-transporting path.

The present invention is made in view of the abovementioned circumstances, and an object of the present invention is to provide an image forming apparatus in which it is possible to transport the paper favorably along the re-transporting path.

According to an aspect of the present invention, there is provided an image forming apparatus which forms an image on a medium, including:

an image forming section which carries out formation of the image on the medium which is transported;

a reverse section which reverses the medium passed through the image forming section; and a re-transporting section which transports the medium, reversed by the reverse section, again to the image forming section, the re-transporting section including:

a re-transporting path extending from the reverse section to the image forming section,

- a drive mechanism which generates a driving force for transporting the medium,
- a first transporting roller which is connected to the drive mechanism to transport the medium,
- a second transporting roller which transports the medium in cooperation with the first transporting roller,
- a first transmitting section having a first gear which is rotatable integrally with the first transporting roller, and transmitting the driving force of the drive mechanism to the first transporting roller, and
- a second transmitting section which transmits the driving force transmitted to the first transmitting section to the second transporting roller, having: a second gear which is engaged with the first gear; a shaft which is extended in a direction intersecting a rotational axis of the first transporting roller and a rotational axis of the second transporting roller, and which is rotatable integrally with the second gear; a third gear which is rotatable integrally with the shaft; and a fourth gear which is engaged with the third gear and which is rotatable integrally with the second transporting roller.

According to the image forming apparatus of the present invention, as compared to a structure in which a conventional timing belt is used, it is not necessary to control tension of the components of the transmission mechanism such as the first gear, the second gear, the third gear, the fourth gear, and the shaft, at the time of assembling. Moreover, as compared to a timing belt which is deformed repeatedly, the first gear to the fourth gear, and the shaft are hardly deteriorated. Therefore, in this image forming apparatus, it is possible to transmit appropriately the driving force from the driving mechanism to the first and second transporting rollers by the first gear to the fourth gear, and the shaft.

Consequently, according to the image forming apparatus of the present invention, it is possible to transport the paper favorably along the re-transporting path, and as a result, a defect such as paper jam hardly occurs.

Moreover, in the image forming apparatus of the invention, since the gears from the first gear to the fourth gear are engaged with each other, the first and second transporting rollers are biased toward one-end side or the other end side of a rotational axis of the first and second transporting of the rollers. Therefore, a play (backlash) of the first and second transporting rollers in the rotational axis direction hardly occurs. As a result, in this image forming apparatus, it is possible to suppress a defect of the re-transporting path fluctuating in the rotational axis direction of the first and second transporting rollers.

The first and second transporting rollers may be arranged in a zigzag form (staggered form) or may be arranged in a plurality of rows.

Moreover, 'a structure which is rotatable integrally' includes not only a structure which rotates integrally but also a structure which rotates by interposing a joint or a gear in between.

DETAILED DESCRIPTION OF THE PREFERRED EMBODIMENTS

Figure 1:
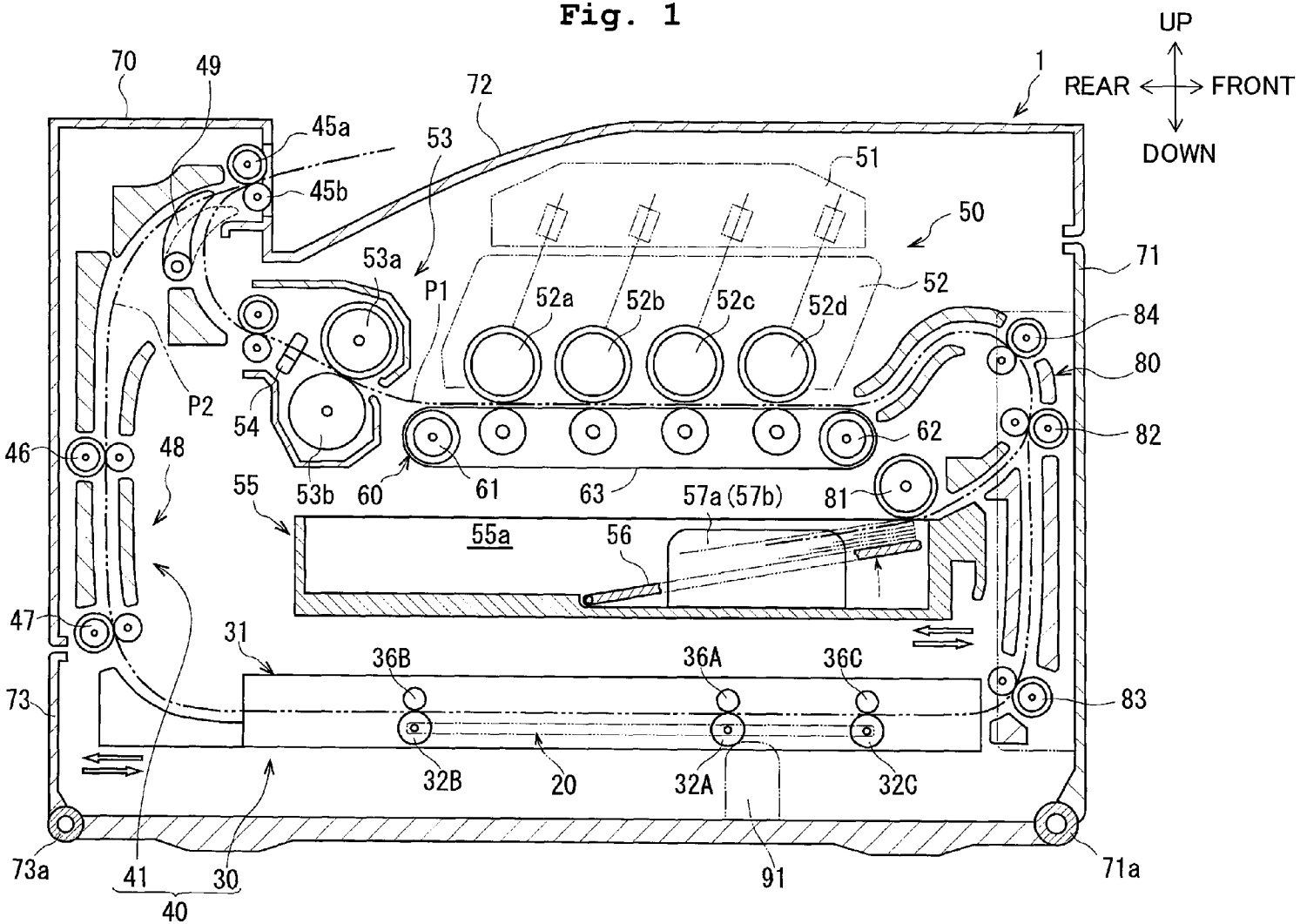
FIG. 1 is a schematic structural view of an image forming apparatus according to a first embodiment of the present invention.

Embodiments from a first embodiment to a fifth embodiment in which the present invention has been substantiated will be described below with reference to the accompanying diagrams. In FIG. 1, a frontward direction and a rearward direction, and an upward direction and a downward direction are defined as shown in the diagram. Further, a frontward side of a normal direction perpendicular to a paper surface is defined as a left side, and a rearward side (an inner side) of the normal direction is defined as a right side. Moreover, frontward/rearward directions, leftward/rightward directions, and upward/downward directions in FIGS. 2 to 10 are indicated corresponding to directions defined in FIG. 1.

First Embodiment

A structure of a printer 1 as an image forming apparatus of a first embodiment will be described below.

<Housing>

A housing 70 is a casing having a box shape, and a frame member which is not shown in the diagram is provided at an inner side thereof. A paper feeding cassette 55, a feeder section 80, an image forming section 50, a transporting mechanism 60, a paper reverse section (a paper return section) 41, and a re-transporting section 30 are assembled in the frame member. The image forming section 50 is positioned at a substantial center of the housing 70. The paper feeding cassette 55 is positioned below the image forming section 50, and the re-transporting section 30 is positioned above the paper feeding cassette 55.

A paper discharge tray 72 is provided at an upper-surface side of the housing 70. After the image formation is completed, papers and OHP sheets etc. (hereinafter, called as 'paper') discharged to an outside of the housing 70 are accumulated in the paper discharge tray 72.

An openable panel 71, which is pivotable frontward around a hinge 71*a* located at a lower-end of a front-side surface of the housing 70, is installed on the front-side surface of the housing 70. A part of the feeder section 80 excluding a paper feeding roller 81 etc. is fixed to an inner-wall surface of the openable panel 71 via a frame member which is not shown in the diagram. When the openable panel 71 is opened, the feeder section 80 is also pivoted frontward around the hinge 71*a*, and a front-surface side of the housing 70 is opened. Moreover, when the paper feeding cassette 55 moves in a frontward/rearward direction in this state, it is possible to mount/dismount the paper feeding cassette 55 onto/from the housing 70.

An openable panel 73, which is pivotable rearward around a hinge 73*a* located at a lower-end side of the rear-surface side of the housing 70 and which opens the rear-surface side of the housing 70, is installed at the rear-surface side of the housing 70. When the re-transporting section 30 is moved in the frontward/rearward direction while the openable panel 73 opened, it is possible to mount/dismount the re-transporting section 30 onto/from the housing 70.

<Paper Feeding Cassette>

The paper feeding cassette 55 is a box-shaped member having a paper accommodating chamber 55*a* which is openable upward. A pushing plate 56 is installed at a front of a bottom portion of the paper accommodating chamber 55*a*. A front-end side of the pushing plate 56 is pivotable vertically (up and down). At the time of feeding a paper to the image forming section 50, the pushing plate 56 is pivoted to push up a front-end side of a paper accommodated in the paper accommodating section 55*a*, thereby pushing the paper against the paper feeding roller 81 located above the paper accommodating section 55*a*. Moreover, a pair of width-direction guide plates 57*a* and 57*b* facing in left-right direction are provided in the paper accommodating chamber 55*a*. The width-direction guide plates 57*a* and 57*b* make a contact with two ends of the paper, respectively, in a width direction of the paper, and position the transported paper with respect to a center line of the paper in the width direction. In the following description, transporting of a paper, in which the paper is not positioned at one-end of the paper in the width direction but is positioned with respect to the center line of the paper in the width direction is called as a 'center register feeding'.

<Feeder Section>

The feeder section 80 includes the paper feeding roller 81, transporting rollers 82 and 83, and a register roller 84.

The paper feeding roller 81 is provided above a front-end side of the paper feeding cassette 55, and transports the paper mounted in the paper feeding cassette 55, to the image forming section 50. A separating pad which is not shown in the diagram is arranged below a front side of the paper feeding roller 81. The separating pad imparts a predetermined transporting resistance to the paper to separate one-by-one the papers fed by the paper feeding roller 81.

The transporting path P1 includes a U-turn portion taking a U-turn at a frontward side in the housing 70, and the paper fed from the paper feeding cassette 55 is transported to the image forming section 50 through a paper transporting path P1. The transporting roller 82 is arranged at the U-turn portion, of the paper transporting path P1. The transporting roller 82 applies a transporting force to the paper to transport to the image forming section 50 with the paper being bent in a substantial U-shape.

The register roller 84 is arranged at a downstream side, of the transporting path P1, than the transporting roller 82, and makes a contact with a front end of the paper which is transported by the transporting roller 82. Accordingly, the register roller 84 corrects a skewing of the paper, and transports the paper further toward the image forming section 50.

The transporting roller 83 is arranged below the transporting roller 82 and at a front side of the re-transporting section 30, and imparts a transporting force to the paper turned over by a reverse-transporting mechanism 40 to guide the reversed paper once again to the transporting path P1.

<Transporting Mechanism>

The transporting mechanism 60 includes a drive roller 61 which rotates in conjunction with the image forming section 50, a driven roller 62 which is rotatably installed at a position away from the drive roller 61, and a transporting belt 63 which is put around the drive roller 61 and the driven roller 62.

Moreover, the transporting belt 63 rotates in a state of the paper P mounted thereon. Accordingly, the transporting belt 63 transports the paper which has been transported from the paper feeding cassette 55 along the transporting path P1, and sends to a lower side of a developer toner cartridge 52 of the image forming section 50.

<Image Forming Section>

In the printer 1 of the first embodiment, the image forming section 50 of an electro-photographic type is used. In the image forming apparatus of the present invention, the image forming section is not restricted to the image forming section in the first embodiment, and it is possible to use an image forming apparatus of the electro-photographic type, a thermal type, an ink jet type, and other common image forming types.

The image forming section 50 is of a so-called direct tandem type capable of color printing, and includes a scanner section 51, the developer toner cartridge (developing section) 52, and a fixing unit (transfer section) 53.

The developer toner cartridge 52 is a set of four cartridges corresponding to toners (developer) of four colors namely black, yellow, magenta, and cyan, and these four cartridges are arranged to be lined up serially along a direction of transporting of paper. The developer toner cartridge 52 includes photosensitive drums 52*a*, 52*b*, 52*c*, and 52*d*, a developing roller, a charger, and a toner accommodating portion (not shown in the diagram).

The scanner section 51 is provided at an upper portion in the housing 70, and includes a laser source, a polygon mirror, an fθ lens, and a reflecting mirror. The scanner section 51 forms an electrostatic latent image on a surface of each of the photosensitive drums 52*a*, 52*b*, 52*c*, and 52*d* in the developer toner cartridge 52.

The fixing unit 53 is arranged at a downstream side of the photosensitive drums 52*a*, 52*b*, 52*c*, and 52*d* in the transporting path P1 of the paper. The fixing unit 52 includes a heating roller 53*a* and a pressurizing roller 53*b*. The heating roller 53*a* is arranged toward an image forming surface of the paper. When the heating roller 53*a* is driven and rotated in synchronization with the transporting belt 63 etc., the heating roller 53*a* imparts a transporting force to the paper while heating the toner. Whereas, the pressurizing roller 53*b* is arranged at an opposite side of the heating roller 53*a*, sandwiching the paper, and presses the paper toward the heating roller 53*a*. The pressurizing roller 53*b* is driven and rotated upon receiving a rotational force from the heating roller 53*a* via the paper which is in contact with the heating roller 53*a*.

A paper discharge sensor 54 which faces the transporting path P1 is provided at a rear side of the heating roller 53*a* and the pressurizing roller 53*b*. In the reverse-transporting of the paper which will be described later, a rear end of the paper is detected by the paper discharge sensor 54, and at a predetermined timing after the detection, paper discharge rollers 45*a* and 45*b* rotating in the normal direction are made to rotate in the reverse direction.

The image forming section 50 having such structure forms an image on the paper as described below. In other words, when the photosensitive drums 52*a*, 52*b*, 52*c*, and 52*d* rotate, surfaces thereof are charged uniformly to positive polarity by a charger, and thereafter, are exposed by being scanned at a high speed by a laser beam irradiated from the scanner section 51. Accordingly, electrostatic latent images corresponding to an image to be formed on the paper are formed on the surface of each of the photosensitive drums 52*a*, 52*b*, 52*c*, and 52*d*.

Next, toner from a toner accommodating section is supplied to the surfaces of the photosensitive drums 52*a*, 52*b*, 52*c*, and 52*d* corresponding to the electrostatic latent images, and the toner carried on the surfaces of the photosensitive drums 52*a*, 52*b*, 52*c*, and 52*d* is transferred to the paper. Further, the paper having the toner transferred thereto is transported to the fixing unit 53 and heated, and the toner is fixed to the paper and the image formation is completed.

<Reverse-Transporting Mechanism>

The reverse-transporting mechanism 40 is a mechanism for forming an image on both front and rear surfaces of the paper, and includes the paper reverse section 41 and the re-transporting section 30. The paper reverse section 41 and the re-transporting section 30 are arranged such that, the paper which has passed through the fixing unit 53 is passes along a re-transporting path P2 returning to the feeder section 80 via a lower portion of the paper feeding cassette 55 from a rear-surface side of the housing 70.

The paper reverse section 41 includes the paper discharge rollers 45*a* and 45*b*, a flapper 49, re-transporting rollers 46 and 47, and a guide 48.

The paper discharge rollers 45*a* and 45*b* are a pair of rollers facing mutually, and can be switched to a rotation in a normal direction and a reverse direction. As it has been described above, the paper discharge rollers 45*a* and 45*b* rotate in a normal direction in a case of discharging the paper onto the paper discharge tray 72, and rotate in a reverse direction in a case of transporting the paper to the re-transporting path P2 upon reversing.

The flapper 49 is provided to face a branched portion of the transporting path P1 and the re-transporting path P2. The flapper 49 is pivoted by excitation or non-excitation of a solenoid which is not shown in the diagram, and switches a transporting path for the paper, which is reversed by the paper discharge rollers 45*a* and 45*b*, from the transporting path P1 to the re-transporting path P2.

The re-transporting rollers 46 and 47, and the guide 48 are arranged in a vertical direction along the re-transporting path P2, to be able to transport the paper from the paper discharger rollers 45*a* and 45*b* up to a rear-end side of the re-transporting section 30 installed at the lowermost side of the housing 70. In the paper reverse section 41, the paper is also transported by center register feeding.

As shown in diagrams from FIGS. 1 to 6, the re-transporting section 30 is arranged at a lower side of the paper feeding cassette 55. A rear-end side of the re-transporting section 30 is arranged at a lower side of the paper reverse section 41, and a front-end side of the re-transporting section 30 is arranged at a rear side of the transporting roller 83. The re-transporting section 30 includes a drive mechanism 91, a transporting tray 31, a first transporting roller 32A, second transporting rollers 32B and 32C, a transmission mechanism 20, and driven rollers 36A, 36B, and 36C.

Figure 4:
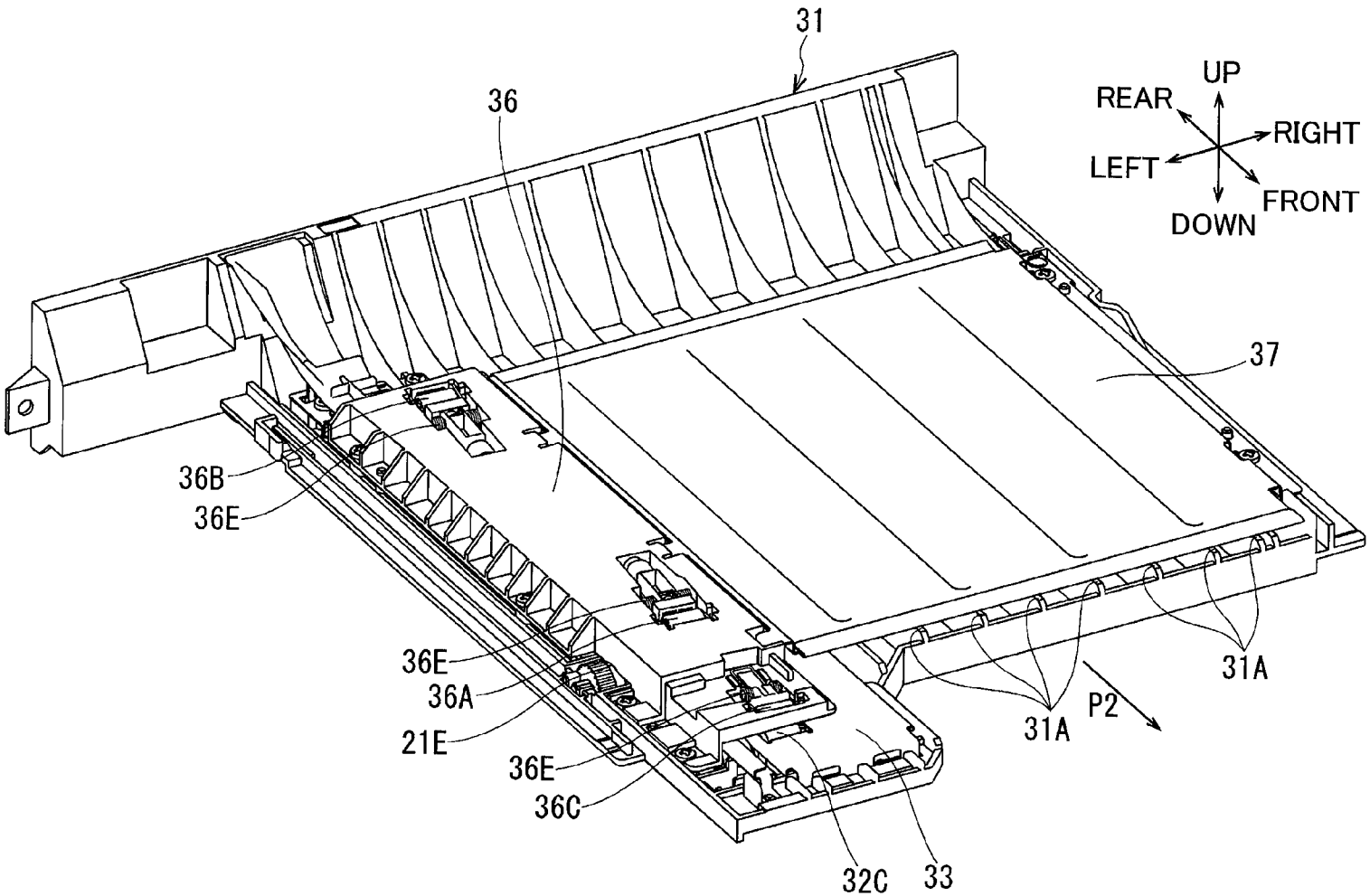
FIG. 4 is a perspective view showing the re-transporting section in the image forming apparatus of the first embodiment, and shows a state in which the lid body has been assembled.
Figure 5:
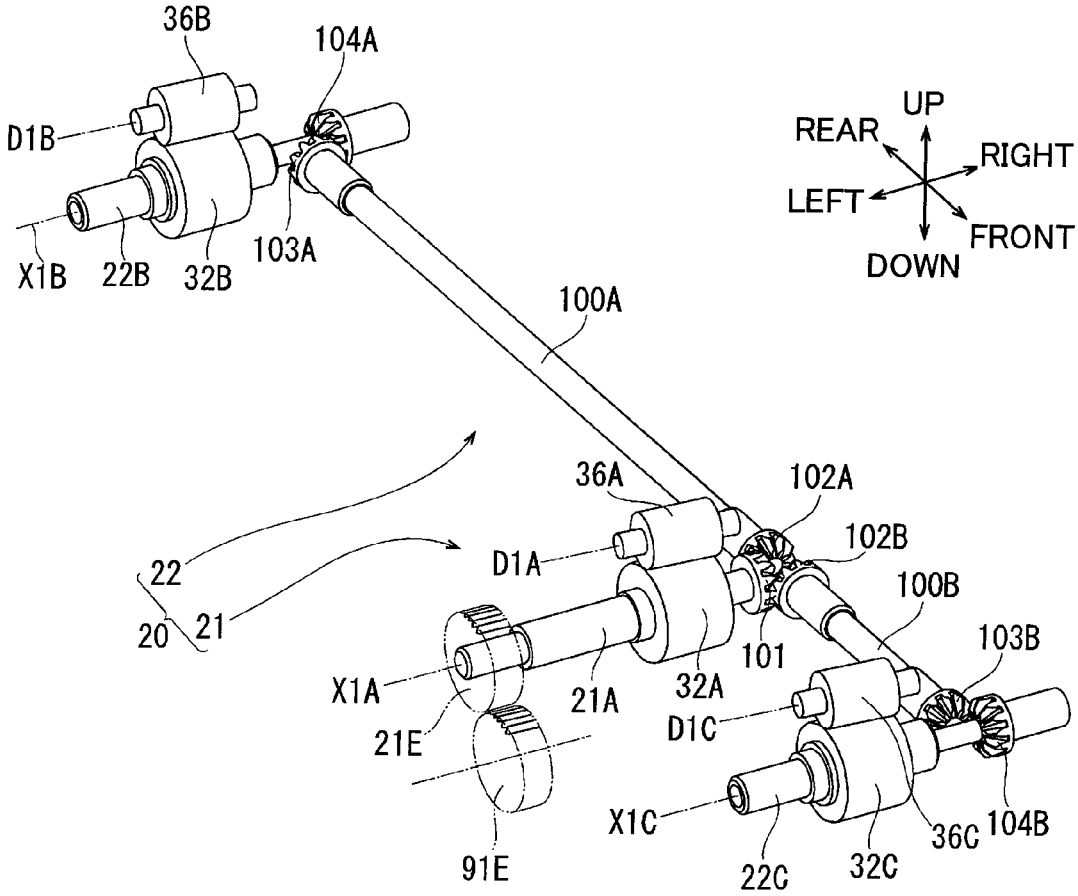
FIG. 5 is a perspective view showing a first transporting roller, second transporting rollers, a transmission mechanism, and driven rollers in the image forming apparatus of the first embodiment.

As shown in FIG. 1, the drive mechanism 91 is provided between a bottom portion of the housing 70 and the transporting tray 31. The drive mechanism 91 may have an electric motor, or may be a structure which distributes a part of a driving force transmitted to the transporting mechanism 60 and the image forming section 50, to the re-transporting section 30. It is possible to mount/dismount the re-transporting section 30 on/from the housing 70 when the re-transporting section 30 moves frontward/rearward in a state of the openable panel 73 opened. At this time, the drive mechanism 91 is engaged with or disengaged from the re-transporting section 30. Here, as shown in FIG. 4, a spur gear 21E near the transmission mechanism 20 is installed in an exposed form, at a left-side surface of the transporting tray 31. Therefore, as shown in FIG. 5, a spur gear 91E near the drive mechanism 91 is engaged with or disengaged from the spur gear 21E near the transmission mechanism 20.

Figure 2:
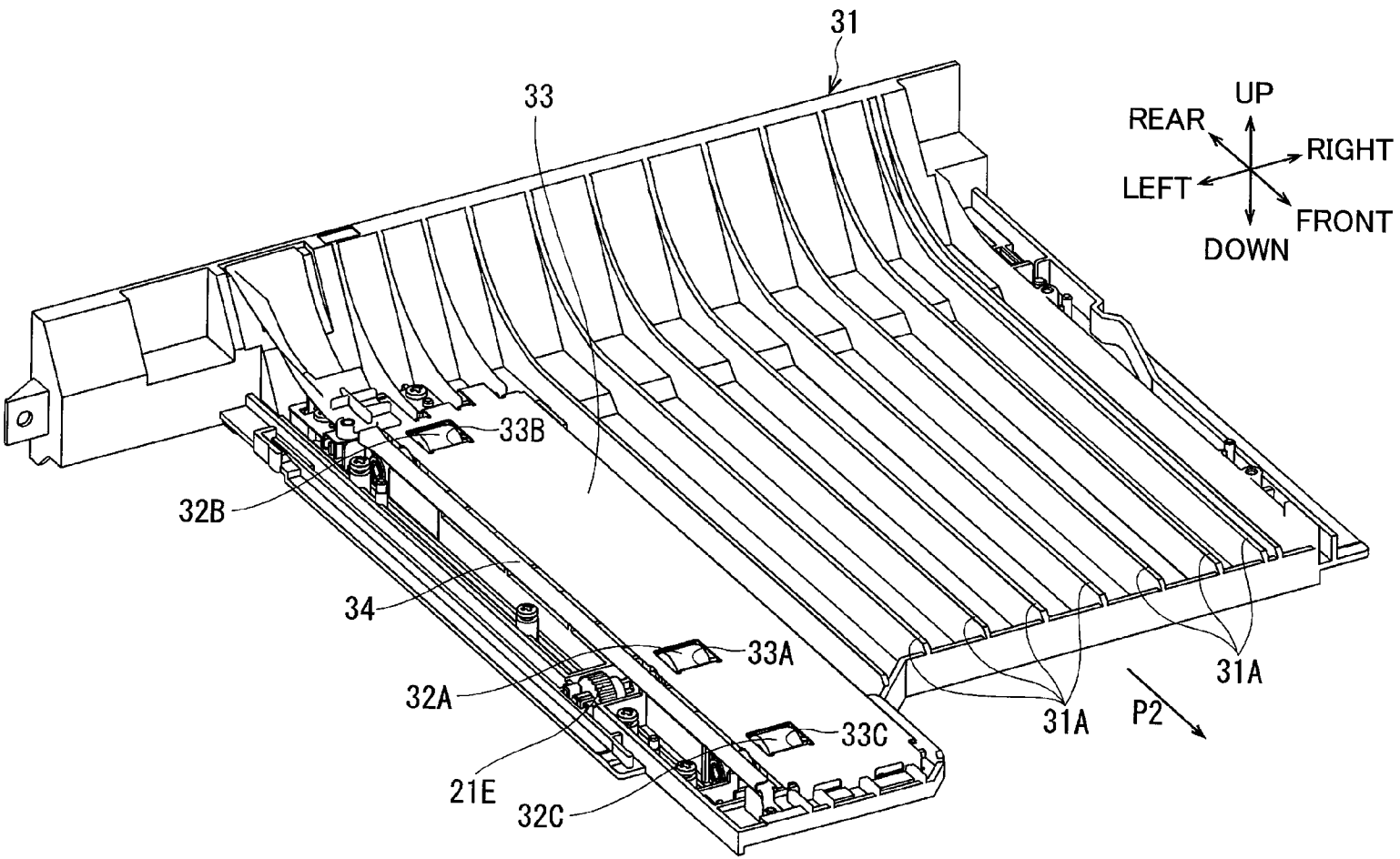
FIG. 2 is a perspective view showing a re-transporting section in the image forming apparatus of the first embodiment, and shows a state in which a lid body (a lid member) has been removed.

As shown in FIG. 2, the transporting tray 31 is a resin molded body (resin molding) made of a resin such as ABS resin. A rear-end side of the transporting tray 31 has a bent shape which is bent toward an upper side. A plurality of guide ribs 31A extended in a frontward and a rearward direction along the re-transporting path P2 is formed integrally at a bottom portion of the transporting tray 31.

A bottom plate 33 is mounted at a left side of each guide rib 31A at a bottom portion of the tray 31. An upper surface of the bottom plate 33 is also a flat surface extended in the frontward and rearward direction along the re-transporting path P2.

Figure 3:
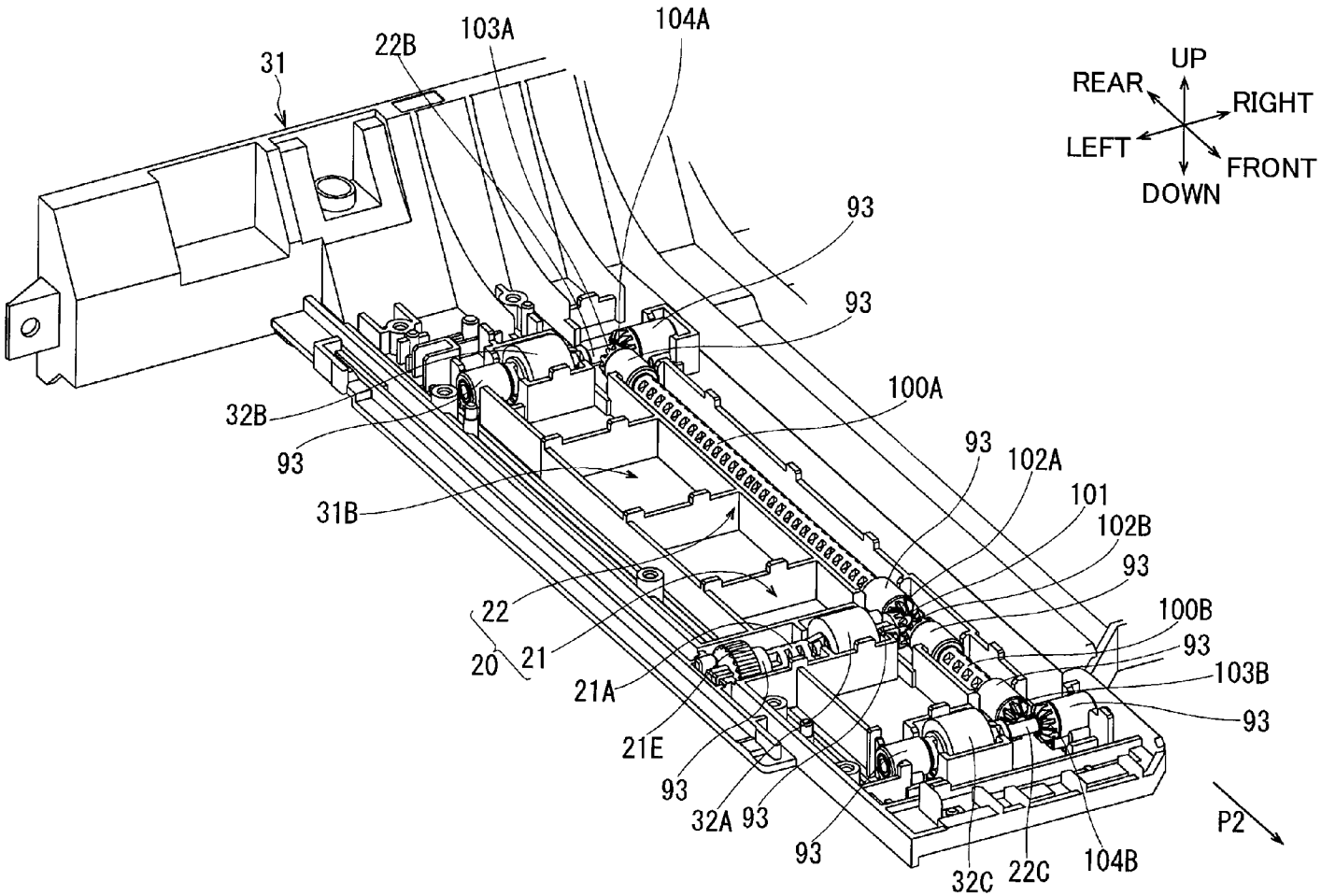
FIG. 3 is an enlarged perspective view of main components showing the re-transporting section in the image forming apparatus of the first embodiment, and shows a state in which, the lid body and a bottom plate have been removed.
Figure 6:
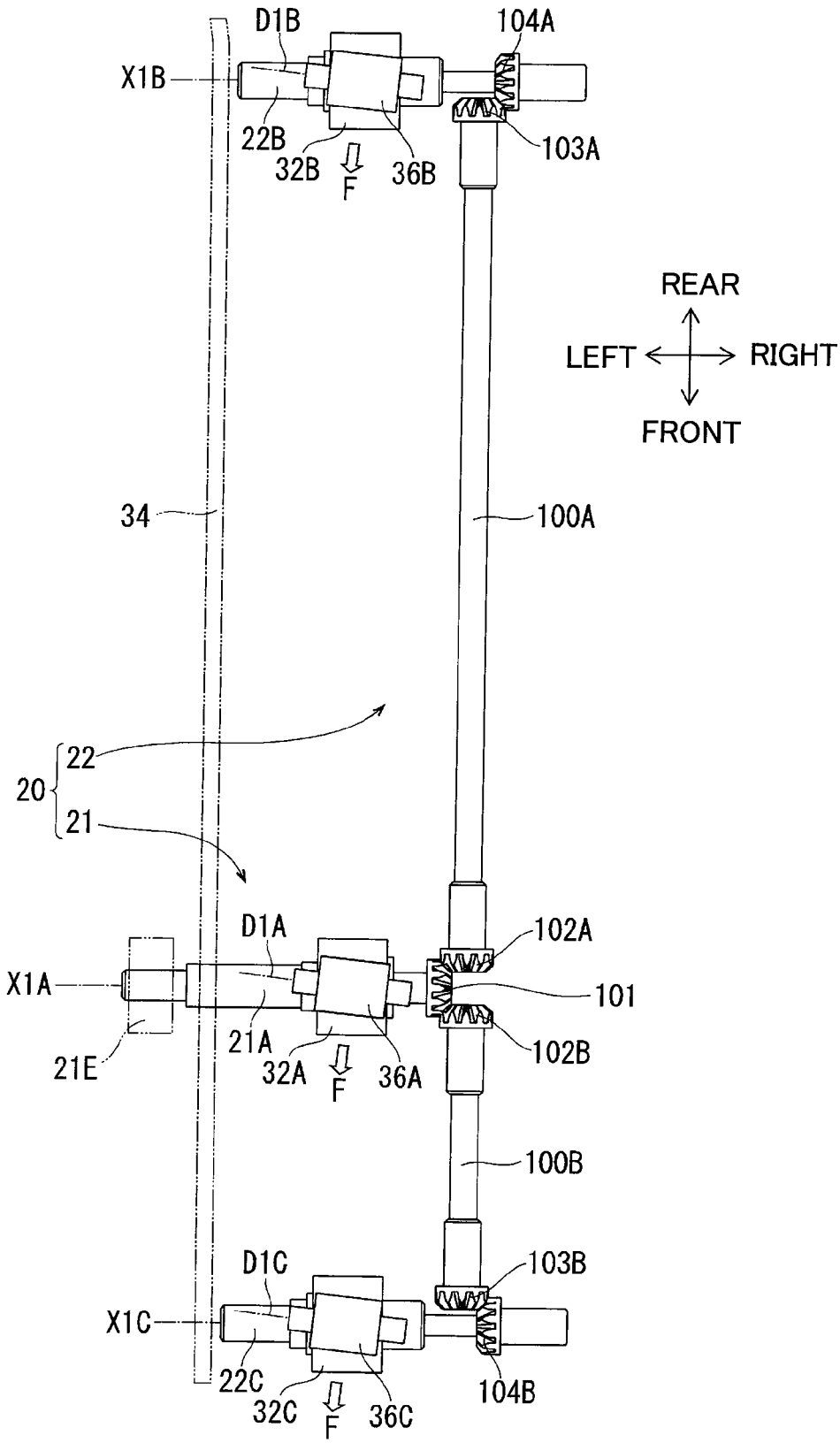
FIG. 6 is a top view showing the first transporting roller, the second transporting rollers, the transmission mechanism, and the driven rollers in the image forming apparatus of the first embodiment.

As shown in FIG. 3, an internal space 31B is formed at a lower-surface side of the bottom plate 33 of the transporting tray 31. The first transporting roller 32A, the second transporting rollers 32B and 32C, and the transmission mechanism 20 are accommodated in a state of being supported by a plurality of sliding bearings 93. In FIGS. 5 and 6, the first transporting roller 32A, the second transporting rollers 32B and 32C, and the transmission mechanism 20 are picked up to show. The details thereof will be described later.

As shown in FIG. 2, three openings 33A, 33B, and 33C lined up in a frontward and rearward direction are formed in the bottom plate 33. Upper portions of the first transporting roller 32 and the second transporting rollers 32B and 32C which are arranged in the internal space 31B, are exposed through the openings 33A, 33B, and 33C. A width-direction guide plate 34 is provided to be extended in a frontward and rearward direction at a further left side of the openings 33A, 33B, and 33C in an upper surface of the bottom plate 33. The width-direction guide plate 34 determines a position in a width direction (side register feeding) by making a contact with one-end side in a width direction of the paper when the paper is transported on the transporting tray 31 along the re-transporting path P2.

As shown in FIG. 4, lid bodies (lid members) 36 and 37 which are resin molded bodies (resin moldings) made of a resin such as ABS resin, are assembled at an upper side of the transporting tray 31. A gap through which the paper can pass is formed between the lid bodies 36 and 37 and the guide ribs 31A and between the lid bodies 36 and 37 and the bottom plate 33. The lid body 36 is positioned at an upper side of the bottom plate 33. The driven rollers 36A, 36B, and 36C are provided in the lid body 36, at sites positioned at an upper side of the openings 33A, 33B, and 33C. The driven rollers 36A, 36B, and 36C are facing in a vertical direction (upward and downward direction) with respect to the first transporting roller 32A, and the second transporting rollers 32B and 32C. In FIGS. 5 and 6, the driven rollers 36A, 36B, and 36C are picked up to show along with the first transporting roller 32, the second transporting rollers 32B and 32C, and the transmission mechanism 20. The details thereof will be described later.

A bias spring 36E which applies a bias to the driven rollers 36A, 36B, and 36C, toward the first transporting roller 32A and the second transporting rollers 32B and 32C is arranged between the lid body 36 and the driven rollers 36A, 36B, and 36C. The lid bodies 36 and 37 are made to be highly stiff by making thick or by forming a reinforcing rib in order to cope with a reactive force exerted by the bias spring 36E.

Next, the first transporting roller 32A, the second transporting rollers 32B and 32C, the transmission mechanism 20, and the driven rollers 36A, 36B, and 36C will be described below in detail with reference to FIGS. 3, 5, and 6.

The first transporting roller 32A is positioned between the second transporting roller 32B and the second transporting roller 32C as viewed from the frontward and rearward direction. In other words, the second transporting roller 32B is positioned at an upstream side of the re-transporting path P2, with respect to the first transporting roller 32A, and the second transporting roller 32C is positioned at a downstream side of the re-transporting path P2, with respect to the first transporting roller 32A.

As shown in FIGS. 5 and 6, the first transporting roller 32A is fixed at an intermediate portion of a rotating shaft 21A of which rotational axis X1A is directed in a left-right direction, or in other words, a direction orthogonal to the re-transporting path P2. The spur gear 21E is fixed at a left-side end portion of the rotating shaft 21A. Whereas, a first gear 101 which is a bevel gear is fixed, in a state of gear teeth pointing toward a right side, to a right-side end portion of the rotating shaft 21A. As shown in FIG. 3, two end sides of the rotating shaft 21A are rotatably supported by two sliding bearings 93 respectively. The first gear 101 rotates integrally with the rotating shaft 21A, the first transporting roller 32A, and the spur gear 21E.

As shown in FIGS. 5 and 6, the second transporting rollers 32B and 32C are also fixed at an intermediate portion of rotating shafts 22B and 22C of which rotational axes X1B and X1C are directed in a left-right direction, or in other words, the direction orthogonal to the re-transporting path P2 as centers. As shown in FIG. 3, two ends of the rotating shafts 22B and 22C are rotatably supported by two sliding bearings 93 respectively.

As shown in FIGS. 5 and 6, at right-side end portion of the rotating shafts 22B and 22C, fourth gears 104A and 104B which are bevel gears are fixed to be in a state of gear teeth pointing toward a left-side. As shown in FIG. 3, the fourth gear 104A rotates integrally with the rotating shaft 22B and the second transporting roller 32B while a flat surface at a right side thereof making a contact with an end surface of the sliding bearing 93. The fourth gear 104B also rotates integrally with the rotating shaft 22C and the second transporting roller 32C while a flat surface at a right side thereof making a contact with the end surface of the sliding bearing 93.

As shown in FIGS. 5 and 6, a first shaft 100A which is extended in a frontward and rearward direction, or in other words, in a direction orthogonal to the rotational axes X1A, X1B, and X1C is arranged between the first gear 101 and the fourth gear 104A at the upstream side of the re-transporting path P2. As shown in FIG. 3, two end sides of the first shaft 100 are rotatably supported by two sliding bearings 93 respectively.

As shown in FIGS. 5 and 6, a second gear 102A which is a bevel gear is fixed at a front-end portion of the first shaft 100A in a state of being engaged with the first gear 101, with gear teeth of the second gear 102A pointing frontward. Whereas, a third gear 103 which is a bevel gear is fixed at a rear-end portion of the first shaft 100A in a state of being engaged with the fourth gear 104A, with gear teeth of the third gear 103 pointing rearward. The second gear 102A and the third gear 103A rotate integrally with the first shaft 100A.

A second shaft 100B which is extended in a frontward and rearward direction, or in other words, in a direction orthogonal to the rotational axes X1A, X1B, and X1C is arranged between the first gear 101 and the fourth gear 104B at the downstream side of the re-transporting path P2. As shown in FIG. 3, two end sides of the second shaft 100B are rotatably supported by two sliding bearings 93 respectively. The first shaft 100A and the second shaft 100B have same rotational axis.

As shown in FIGS. 5 and 6, a second gear 102B which is a bevel gear is fixed at a rear-end portion of the second shaft 100B in a state of being engaged with the first gear 101, with gear teeth of the second gear 102B pointing rearward. Whereas, a third gear 103B which is a bevel gear is fixed at a front-end portion of the second shaft 100B in a state of being engaged with the fourth gear 104B, with gear teeth of the third gear 103B pointing frontward. The second gear 102B and the third gear 103B rotate integrally with the second shaft 100B.

A first transmitting section 21 which transmits the driving force of the drive mechanism 91 to the first transporting roller 32A, includes the rotating shaft 21A, the first gear 101, and the spur gear 21E. Moreover, a second transmitting section 22 which transmits the driving force of the first transmitting section 21 to the second transporting rollers 32B and 32C includes the second gears 102A and 102B, the first shaft 100A, the second shaft 100B, the third gears 103A and 103B, the fourth gears 104A and 104B, and the rotating shafts 22B and 22C. The transmission mechanism 20, which transmits the driving force of the drive mechanism 91 to the first transporting roller 32A and the second transporting rollers 32B and 32C, includes the first transmitting section 21 and the second transmitting section 22. When the driving force is to be transmitted from the drive mechanism 91 to the rotating shaft 21A via the spur gear 91E and the spur gear 21E by the transmission mechanism 20, the first gear 101 and the second gears 102A and 102B are engaged. Accordingly, the driving force is transmitted to the first shaft 100A and the second shaft 100B. Furthermore, at this time, the third gears 103A and 103B, which are fixed to the end portions of the first shaft 100A and the second shaft 100B, are engaged with the fourth gears 104A and 104B which are fixed to the rotating shafts 22B and 22C, respectively. Accordingly, the driving force is transmitted to the rotating shafts 22B and 22C. In this manner, since the driving force is transmitted from the drive mechanism 91 to the first transporting roller 32A and the second transporting rollers 32B and 32C via the rotating shafts 22B and 22C, the first transporting roller 32A and the second transporting rollers 32B and 32C are rotated in a transporting direction of the paper along the re-transporting path P2.

As shown in FIGS. 5 and 6, rotational axes D1A, D1B, and D1C of the driven shafts 36A, 36B, and 36C are inclined with respect to a left-right direction, or in other words, a direction orthogonal to the re-transporting path P2. The driven rollers 36A, 36B, and 36C exert a force F (shown in FIG. 6) which makes the paper skew (pass obliquely) toward a left side of the re-transporting path P2 when the driven rollers 36A, 36B, and 36C are driven to be rotated pinching the paper with the first transporting roller 32A and the second transporting rollers 32B and 32C. Accordingly, the paper is transported along the re-transporting path P2 while one-end in the width direction of the paper being pressed against the width-direction guide plate 34.

In the printer 1 of the first embodiment having such structure, the paper having an image formed on the front surface is transported along the transporting path P1, and when a rear-end side thereof reaches up to the paper discharge rollers 45*a* and 45*b*, the paper discharge rollers 45*a* and 45*b* are rotated in reverse direction. At this time, the flapper 49 switches the transporting path of the paper from the transporting path P1 to the re-transporting path P2. When the transporting path is switched, the paper is transported to the re-transporting section 30 in a state of the front and rear side of the paper reversed. Moreover, the paper is transported by the side register feeding by the first transporting roller 32A, the second transporting rollers 32B and 32C, the driven rollers 36A, 36B, and 36C, and the width-direction guide plate 34, and is transported once again to the image forming section 50 in a state of being positioned in the width direction of paper. In this manner, the printer 1 is capable of forming a predetermined image on both front and rear surfaces of a paper.

In the printer 1 of the first embodiment, the first gear 101, the second gears 102A and 102B, the third gears 103A and 103B, the fourth gears 104A and 104B, the first shaft 100A, and the second shaft 100B are assembled easily, to be fitted between a plurality of ribs inside the internal space 31B, in a state of the sliding bearings 93 mounted. Therefore, as compared to a timing belt which is commonly used, a tension control is unnecessary for the first gear 101, the second gears 102A and 102B, the third gears 103A and 103B, and the fourth gears 104A and 104B at the time of assembling. Moreover, the first gear 101, the second gears 102A and 102B, the third gears 103A and 103B, the fourth gears 104A and 104B, the first shaft 100A, and the second shaft 100B are hardly deteriorated as compared to the timing belt which is deformed repeatedly. In the printer 1 of the first embodiment, it is possible to transmit the driving force appropriately from the drive mechanism 91 to the first transporting roller 32A and the second transporting rollers 32B and 32C by the first gear 101, the second gears 102A and 102B, the third gears 103A and 103B, the fourth gears 104A and 104B, the first shaft 100A, and the second shaft 100B.

Consequently, in the printer 1 of the first embodiment, it is possible to transport a paper favorably along the re-transporting path P2, and as a result, a defect such as jamming of paper hardly occurs.

Moreover, in the printer 1, due to the engagement of the first gear 101 and the second gears 102A and 102B, the first transporting roller 32A is biased toward a left end of the rotational axis X1A. Moreover, due to the engagement of the third gears 103A and 103B and the fourth gears 104A and 104B, the second transporting rollers 32B and 32C are biased toward a right end of the rotational axes X1B and X1C. Therefore, a play (backlash) in a direction of the rotational axes X1A, X1B, and X1C of the first transporting roller 32A and the second transporting rollers 32B and 32C hardly occurs. As a result, in the printer 1, it is possible to suppress a defect of the re-transporting path P2 fluctuating in the left-right direction or in other words, in the direction of the rotational axes X1A, X1B, and X1C of the first transporting roller 32A and the second transporting rollers 32B and 32C.

Furthermore, in the printer 1 of the first embodiment, the second transporting rollers 32B and 32C are positioned at the upstream side and the downstream side of the re-transporting path P2, with respect to the first transporting roller 32A. In this case, it is possible to reduce the number of joints (joints of shafts) located in the route from the first transporting roller 32A to which the driving force is transmitted directly from the drive mechanism 91, up to the second transporting rollers 32B and 32C. In other words, as shown in FIG. 5, the number of joint portions from the first transporting path 32A up to the second transporting path 32B is two, and similarly, the number of joint portions from the first transporting path 32A and the second transporting path 32C is two. Whereas, in a case of arranging the two second transporting rollers 32B and 32C at one of the upstream side and the downstream side of the first transporting roller 32A, the number of joint portions from the first transporting roller 32A up to at least one of the second transporting rollers 32B and 32C is three or more. For instance, when the first transporting roller 32A and the second transporting rollers 32B and 32C are arranged in an order of the second transporting rollers 32B and 32C, and the first transporting roller 32A from the upstream side, the number of joint portions from the first transporting roller 32A up to the second transporting roller 32B is more than the number of joint portions from the first transporting roller 32A up to the second transporting roller 32C. In this case, since a transmission efficiency of the driving force transmitted from the drive mechanism 91 to the second transporting roller 32B is lower than the transmission efficiency of the driving force transmitted from the drive mechanism 91 to the second transmitting roller 32C, a variation in the driving force which is transmitted to the second transmitted rollers 32B and 32C becomes substantial. Whereas, in the printer 1 of the first embodiment, since it is possible to reduce the variation in the driving force which is transmitted to the second transporting rollers 32B and 32C, it is possible to improve the transmission efficiency of the driving force from the drive mechanism 91. In a case of providing two second transporting rollers which are not directly coupled with the drive mechanism 91, for one first transporting roller which is directly coupled with the drive mechanism 91, it is desirable to provide one second transporting roller each to the upstream side and the downstream side of the first transporting roller as in the first embodiment, from a viewpoint of transmission efficiency of the driving force.

Moreover, in the printer 1 of the first embodiment, two shafts namely, the first shaft 100A and the second shaft 100B which are allocated separately for the upstream side and the downstream side, are used. Therefore, as compared to a case of using one long shaft, it is possible to suppress a twist of the first shaft 100A and the second shaft 100B. Therefore, in the printer 1, it is possible to improve the transmission efficiency of the driving force from the drive mechanism 91.

Furthermore, in the printer 1, since the first gear 101, the second gears 102A and 102B, the third gears 103A and 103B, and the fourth gears 104A and 104B are bevel gears, it is possible to improve a strength and durability of gear teeth as compared to those a combination of crown gears and spur gears.

Second Embodiment

Figure 7:
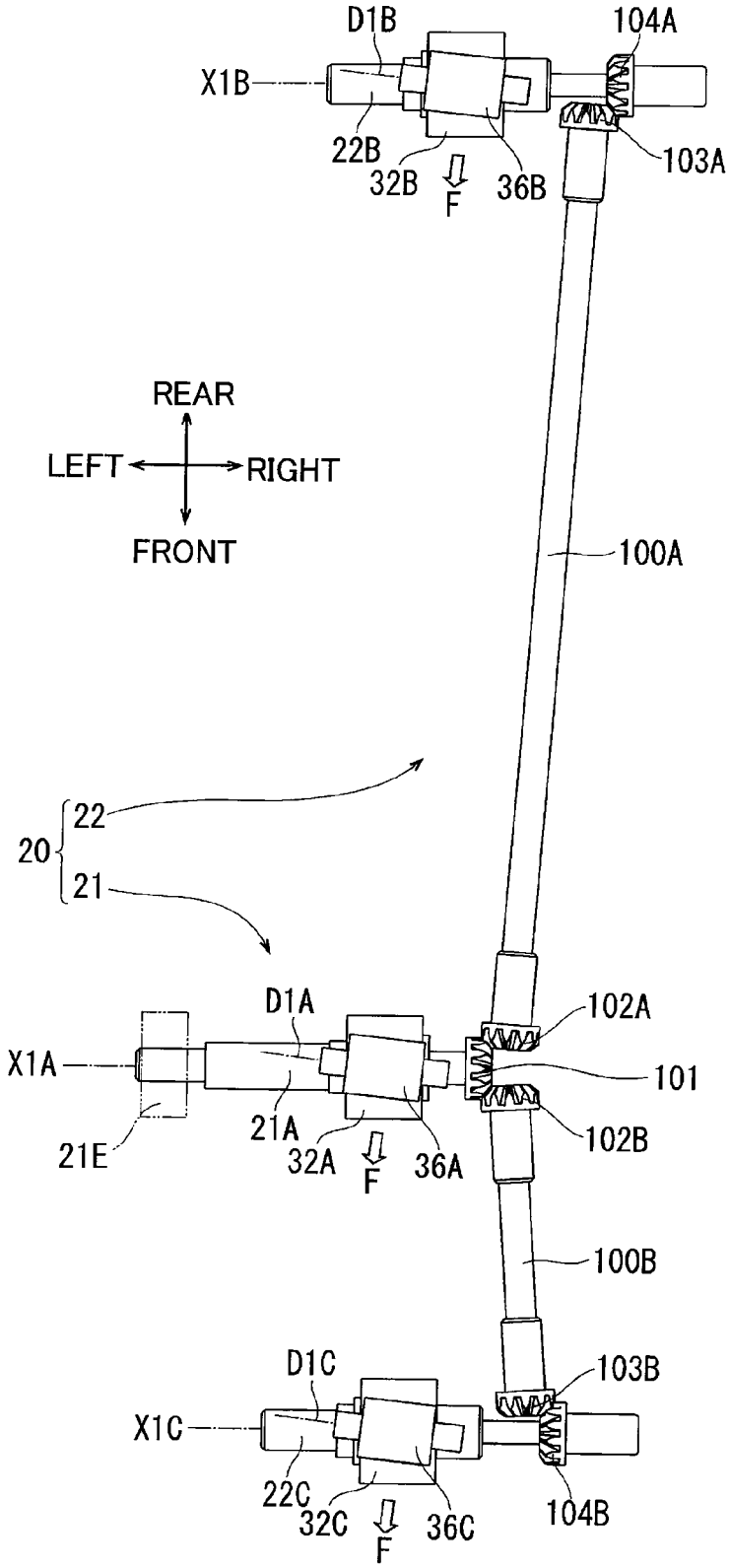
FIG. 7 is a top view showing the first transporting roller, the second transporting rollers, the transmission mechanism, and the driven rollers in an image forming apparatus of a second embodiment.

As shown in FIG. 7, in a printer according to a second embodiment, a layout of components such as the second transporting rollers 32B and 32C, the rotating shafts 22B and 22C, the first shaft 100A, and the second shaft 100B in the printer 1 of the first embodiment, is changed. The rest of the structure is same as the structure of the printer 1 of the first embodiment. Therefore, the above-mentioned changes will be described below in detail, and for the structure identical to the first embodiment, same reference numerals are assigned to components which are same as in the first embodiment, and the description of such components is omitted.

In the printer of the second embodiment, the first shaft 100A is installed in a state of being inclined in a frontward and rearward direction by shifting a rear-end side of a rotational axis thereof toward a rightward direction. The second gear 102A fixed to a front-end portion of the first shaft 100A and the third gear 103A fixed to a rear-end portion of the first shaft 100A rotate integrally with the first shaft 100A, around the rotational axis which is inclined with respect to the frontward and rearward direction.

Whereas, the second shaft 100B is installed in a state of being inclined in a frontward and rearward direction by shifting a front-end side of a rotational axis thereof toward a rightward direction. The second gear 102B fixed to a rear-end portion of the second shaft 100B and the third gear 103B fixed to a front-end portion of the second shaft 100B rotate integrally with the second shaft 100B, around the rotational axis which is inclined with respect to the frontward and rearward direction.

Regarding the second transporting roller 32B and the rotating shaft 22B, the rotational axis X1B is arranged in the left-right direction, or in other words, is arranged in a direction orthogonal to the re-transporting path P2. However, the second transporting roller 32B and the rotating shaft 22B are arranged to be shifted in the rightward direction, as compared to the arrangement in the first embodiment. Moreover, regarding the second transporting roller 32C and the rotating shaft 22C, the rotational axis X1C is arranged in the left-right direction, or in other words, is arranged in a direction orthogonal to the re-transporting path P2. However, the second transporting roller 32C and the rotating shaft 22C are arranged to be shifted in the rightward direction, as compared to the arrangement in the first embodiment.

The printer of the second embodiment having such structure, is also capable of showing a similar action and effect as the printer 1 of the first embodiment.

Figure 8:
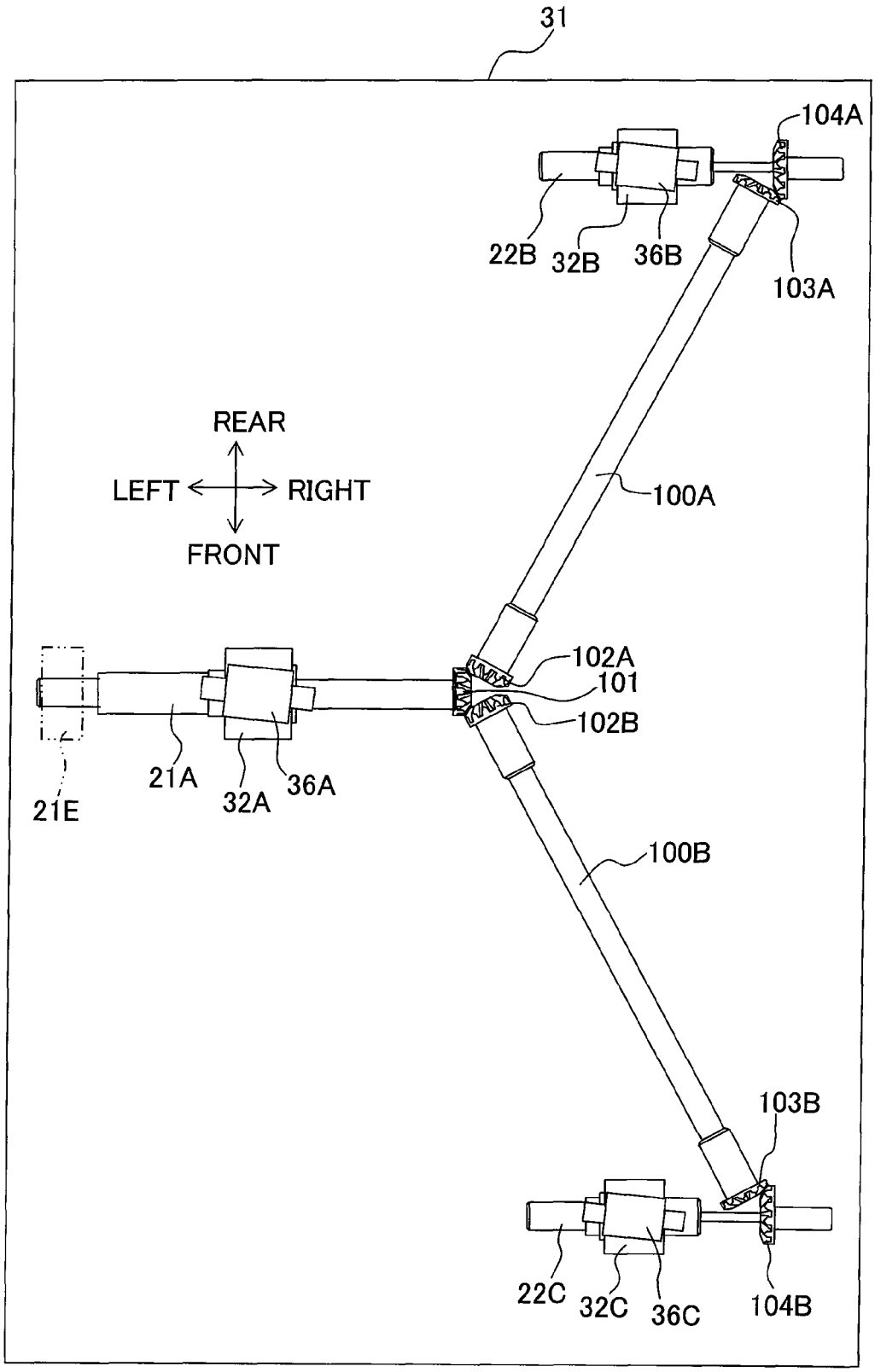
FIG. 8 is a top view showing the first transporting roller, the second transporting rollers, the transmission mechanism, and the driven rollers in an image forming apparatus of another example of the image forming apparatus of the second embodiment.

Moreover, in this printer, since the first gear 101, the second gears 102A and 102B, the third gears 103A and 103B, and the fourth gears 104A and 104B are bevel gears, it is possible to transmit the driving force even when the rotational axes X1A, X1B, and X1C of the first gear 101, and the fourth gears 104A and 104B are not orthogonal to the rotational axes of the second gears 102A and 102B, and the third gears 103A and 103B. Therefore, it is possible to adjust appropriately a direction in which the first shaft 100A and the second shaft 100B are extended, not only in a direction parallel to the re-transporting path P2, but also in a direction inclined with respect to the re-transporting path P2. Therefore, in the printer of the second embodiment, a degree of freedom of layout of the first transporting roller 32A and the second transporting rollers 32B and 32C is improved. For instance, as shown in FIG. 8, the first transporting roller 32A may be arranged at a left side of the transporting tray 31, and the second transporting rollers 32B and 32C may be transported at a right side of the transporting tray 31. In this case, it is possible to impart a transporting force to both left and right ends of the paper which is transported, and to transport the paper stably.

For letting both the engagement of the first gear 101 and the second gear 102A, and the engagement of the first gear 101 and the second gear 102B to be in a suitable state, it is desirable to let an angle of intersection of the rotational axis X1A and the rotational axis of the first shaft 100A same as an angle of intersection of the rotational axis X1A and the rotational axis of the second shaft 100B as shown in FIG. 7.

Third Embodiment

Figure 9:
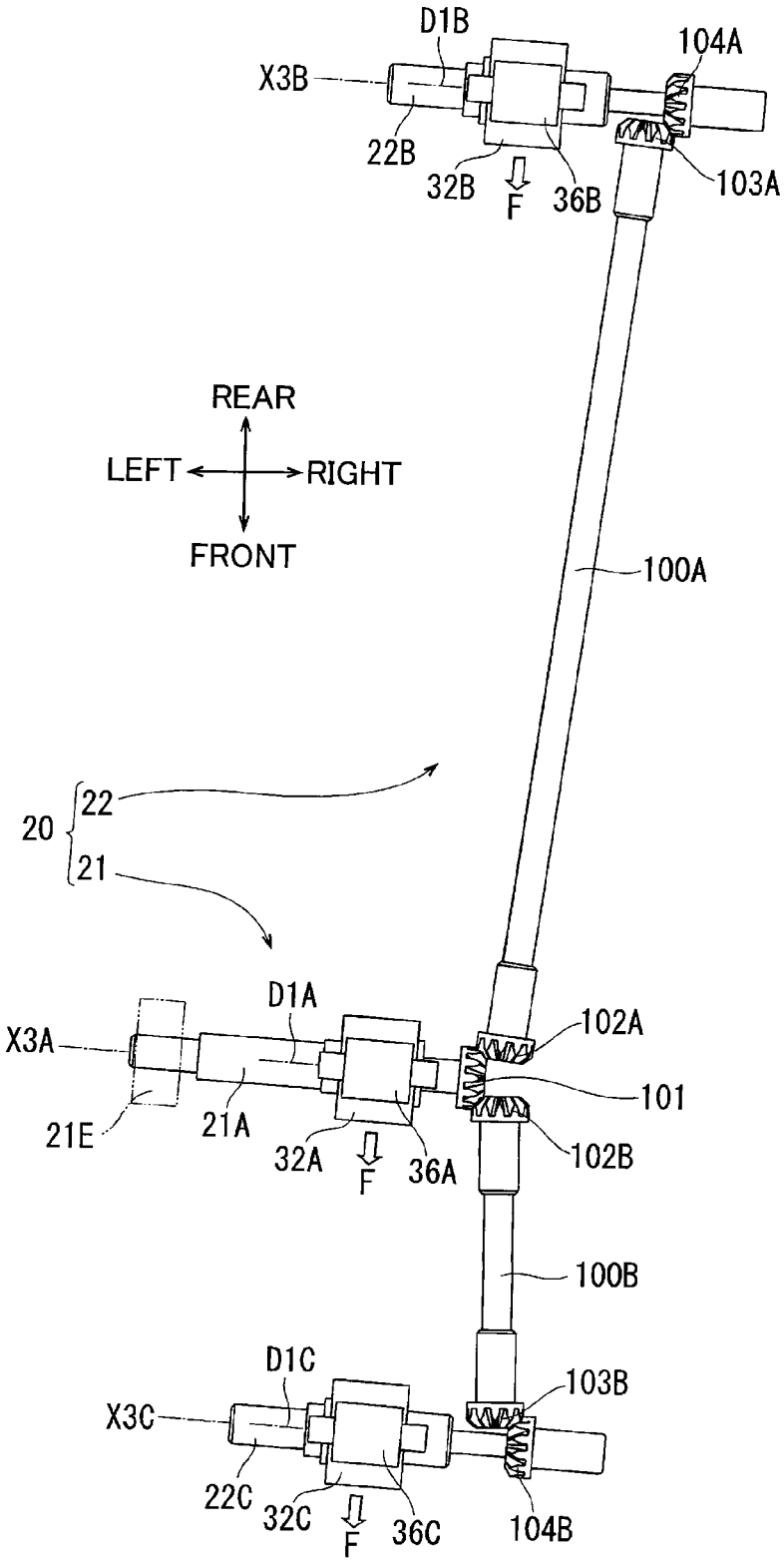
FIG. 9 is a top view showing the first transporting roller, the second transporting rollers, the transmission mechanism, and the driven rollers in an image forming apparatus of a third embodiment.

In a printer of a third embodiment, with the relative positional relationship of the components such as the first transporting roller 32A, the second transporting rollers 32B and 32C, the rotating shafts 21A, 22B, and 22C, the first shaft 100A, and the second shaft 100B in the printer of the second embodiment maintained as it is, the rotational axes X1A, X1B, and X1C of the first transporting roller 32A and the second transporting rollers 32B and 32C shown in FIG. 7 are changed to rotational axes X3A, X3B, and X3C shown in FIG. 9. In other words, a layout of the first transporting roller 32A, the second transporting rollers 32B and 32C, the rotating shafts 21A, 22B, and 22C, the first shaft 100A, and the second shaft 100B in the printer of the second embodiment is changed to a layout as shown in FIG. 9 by rotating in a clockwise direction, facing a paper surface in FIG. 7. At this time, a layout of the driven rollers 36A, 36B, and 36C in the printer of the second embodiment is not changed. The rest of the structure is same as the structure of the printer 1 of the first embodiment. Therefore, the abovementioned changes will be described below in detail, and for the structure identical to the first embodiment, same reference numerals are assigned to components which are same as in the first embodiment, and the description of such components is omitted.

In the printer of the third embodiment, the rotational axes X3A, X3B, and X3C of the first transporting roller 32A, and the second transporting rollers 32B and 32C are parallel to rotational axes D1A, D1B, and D1C of the driven rollers 36A, 36B, and 36C. In other words, the rotational axes X3A, X3B, and X3C are inclined with respect to the direction orthogonal to the re-transporting path P2. In FIG. 9, an angle of inclination of the rotational axes X3A, X3B, and X3C is same. However the angle of inclination of the rotational axes X3A, X3B, and X3C can be set to be different. Moreover, in FIG. 9, the angle of inclination of the rotational axes X3A, X3B, and X3C is shown exaggeratedly. However, practically, the angle of inclination is set to a small angle of about 1° to few degrees.

Similarly as in the second embodiment, since the first gear 101, the second gears 102A and 102B, the third gears 103A and 103B, and the fourth gears 104A and 104B are bevel gears, it is possible to transmit the driving force even when the rotational axes X3A, X3B, and X3C of the first gear 101, and the fourth gears 104A and 104B are not let to be orthogonal to the rotational axes of the second gears 102A and 102B, and the third gears 103A and 103B.

The printer of the third embodiment having such structure is also capable of showing a similar action and effect as the printer 1 of the first embodiment.

Moreover, in the printer of the third embodiment, the rotational axes X3A, X3B, and X3C are inclined with respect to the direction orthogonal to the re-transporting path P2. Therefore, the first transporting roller 32A, the second transporting rollers 32B and 32C, and the driven rollers 36A, 36B, and 36C strongly exerts a force F which skews the paper toward one side in the width direction of the re-transporting path P2. As a result, in the printer of the third embodiment, it is possible to exert assuredly the force F which skews the paper. Accordingly, it is possible to reduce a bias which presses the driven rollers 36A, 36B, and 36C against the first transporting roller 32A, and the second transporting rollers 32B and 32C. Therefore, in the printer of the third embodiment it is possible to simplify the bias spring 36E, and to make the lid bodies 36 and 37 thin. As a result, a size reduction and a cost reduction are facilitated in the printer of the third embodiment.

In FIG. 9, an example in which the first transporting roller 32A, and the second transporting rollers 32B and 32C are lined up in a straight line parallel to the re-transporting path P2 has been cited. However, it is also possible to make an arrangement such that the first transporting roller 32A, and the second transporting rollers 32B and 32C are lined up in a straight line parallel to the re-transporting path P2 while inclining the rotational axes X3A, X3B, and X3C.

Fourth Embodiment

Figure 10:
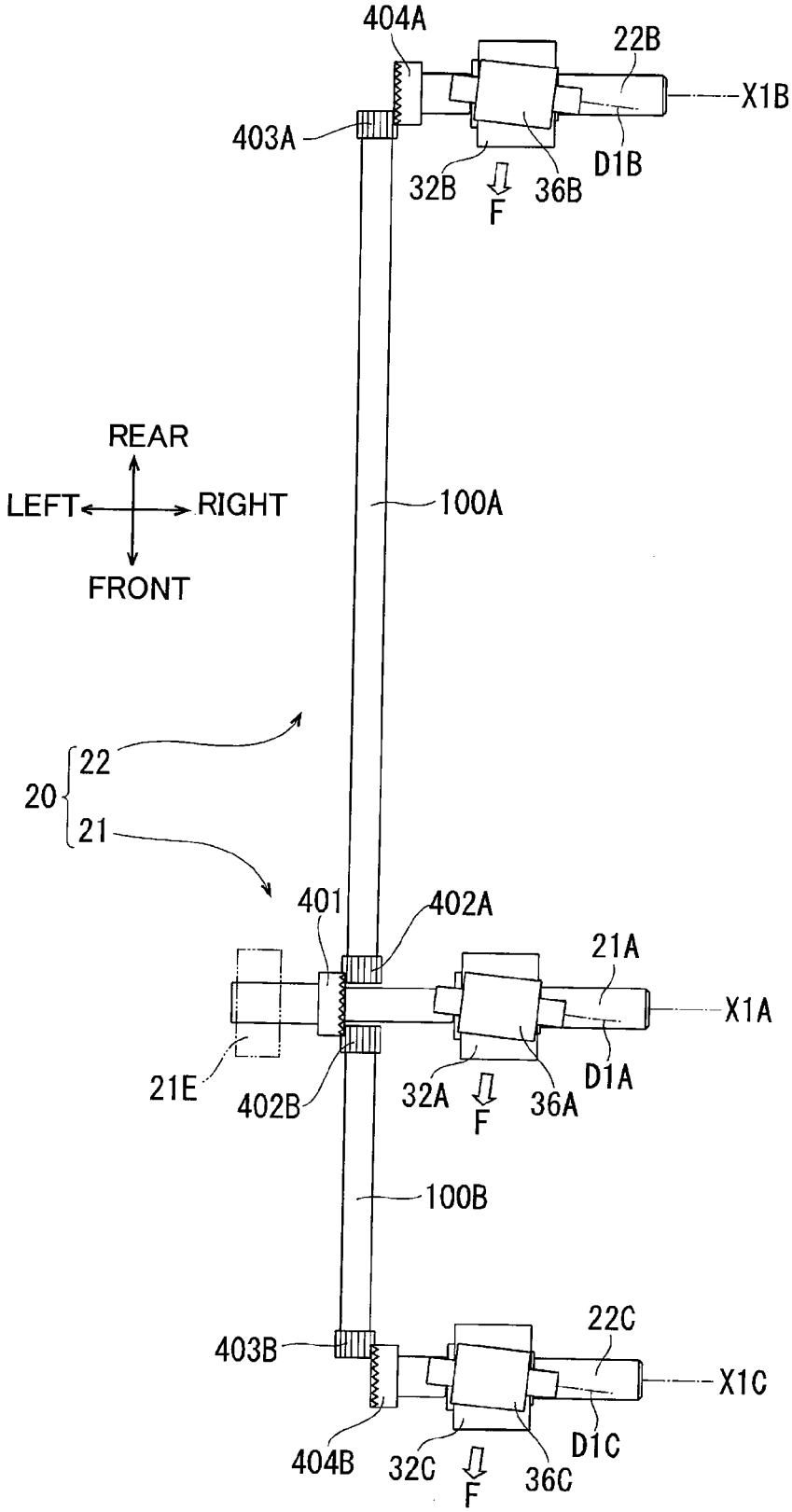
FIG. 10 is a top view showing the first transporting roller, the second transporting rollers, the transmission mechanism, and the driven rollers in an image forming apparatus of a fourth embodiment.

As shown in FIG. 10, in a printer of a fourth embodiment, a first gear 401 and fourth gears 404A and 404B which are crown gears, and second gears 402A and 402B as well as third gears 403A and 403B which are spur gears are used instead of the first gear 101, the second gears 102A and 102B, the third gears 103A and 103B, and the fourth gears 104A and 104B in the printer of the first embodiment. The rest of the structure is same as the structure of the printer 1 of the first embodiment. Therefore, the abovementioned changes will be described below in detail, and for the structure identical to the first embodiment, same reference numerals are assigned to components which are same as in the first embodiment, and the description of such components is omitted.

In the rotating shaft 21A, the first gear 401 which is a crown gear is fixed between the spur gear 21E and the first transporting roller 32A, with gear teeth of the first gear 401 pointing rightward.

The fourth gears 404A and 404B which are crown gears are fixed at a left-side end portion of the rotating shafts 22B and 22C, with gear teeth of the fourth gears 404A and 404B pointing leftward.

The second gears 402A and 402B, and the third gears 403A and 403B which are spur gears are fixed at a front-end side and a rear-end side of the first shaft 100A and the second shaft 100B. The second gears 402A and 402B, and the third gears 403A and 403B are engaged with one of the first gear 401, and the fourth gears 404A and 404B.

The printer of the fourth embodiment having such structure is also capable of showing a similar action and effect as the printer 1 of the first embodiment.

Moreover, in the printer of the fourth embodiment, since crown gears and spur gears which have a simple structure, are used as the first gear 401, the second gears 402A and 402B, the third gears 403A and 403B, and the fourth gears 404A and 404B, a reduction in a manufacturing cost is facilitated.

Fifth Embodiment

Figure 11:
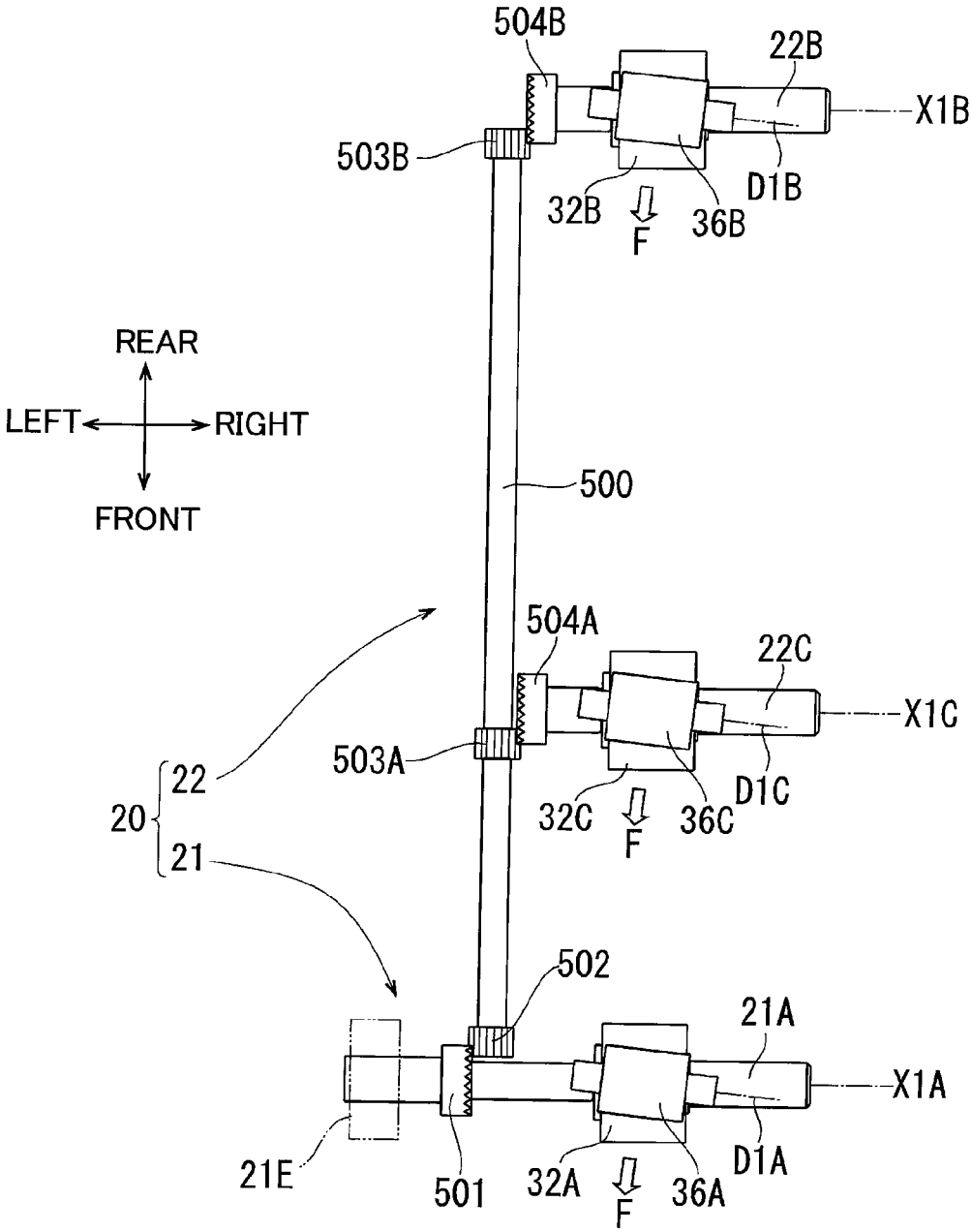
FIG. 11 is a top view showing the first transporting roller, the second transporting roller, the transmission mechanism, and the driven rollers in an image forming apparatus of a fifth embodiment.

As shown in FIG. 11, in a printer of a fifth embodiment, as compared to the printer of the first embodiment, a position of the second transporting roller 32C is changed to be between the first transporting roller 32A and the second transporting roller 32B. Moreover, one long shaft 500 is used instead of the first shaft 100A and the second shaft 100B. Furthermore, a first gear 501, and fourth gears 504A and 504B which are crown gears, and a second gear 502 as well as third gears 503A and 503B which are spur gears, are used. The rest of the structure is same as the structure of the printer 1 of the first embodiment. Therefore, the above-mentioned changes will be described below in detail, and for the structure identical to the first embodiment, same reference numerals are assigned to components which are same as in the first embodiment, and the description of such components is omitted.

In the printer of the fifth embodiment, the second transporting rollers 32B and 32C are positioned at a downstream side of the re-transporting path P2, with respect to the first transporting roller 32A.

In the rotating shaft 21A, the first gear 501 which is a crown gear is fixed between the spur gear 21E and the first transporting roller 32A, with gear teeth of the first gear 501 pointing rightward.

The fourth gears 504A and 504B which are crown gears are fixed at a left-side end portion of the rotating shafts 22B and 22C, with gear teeth of the fourth gears 504A and 504B pointing leftward.

One long shaft 500 which is extended in a frontward and rearward direction, or in other words, a direction orthogonal to the rotational axes X1A, X1B, and X1C is provided between the first gear 501 and the fourth gear 504B. Although it is omitted in the diagram, the shaft 500 is rotatably supported by the sliding bearings 93 at a plurality of locations.

The second gear 502 which is a spur gear, is fixed to a front-end side of the shaft 500. The third gears 503A and 503B which are spur gears, are fixed to an intermediate portion and a rear-end side of the shaft 500. Each of the second gear 502, and the third gears 503A and 503B is engaged with one of the first gear 501, and the fourth gears 504A and 504B.

The printer of the fifth embodiment having such structure is also capable of showing a similar action and effect as the printer 1 of the first embodiment.

Moreover, in the printer of the fifth embodiment, since it is possible to transmit the driving force to the second transporting rollers 32B and 32C by one shaft 500, it is possible to realize a reduction of the number of components and a reduction of size of an apparatus.

Figure 12:
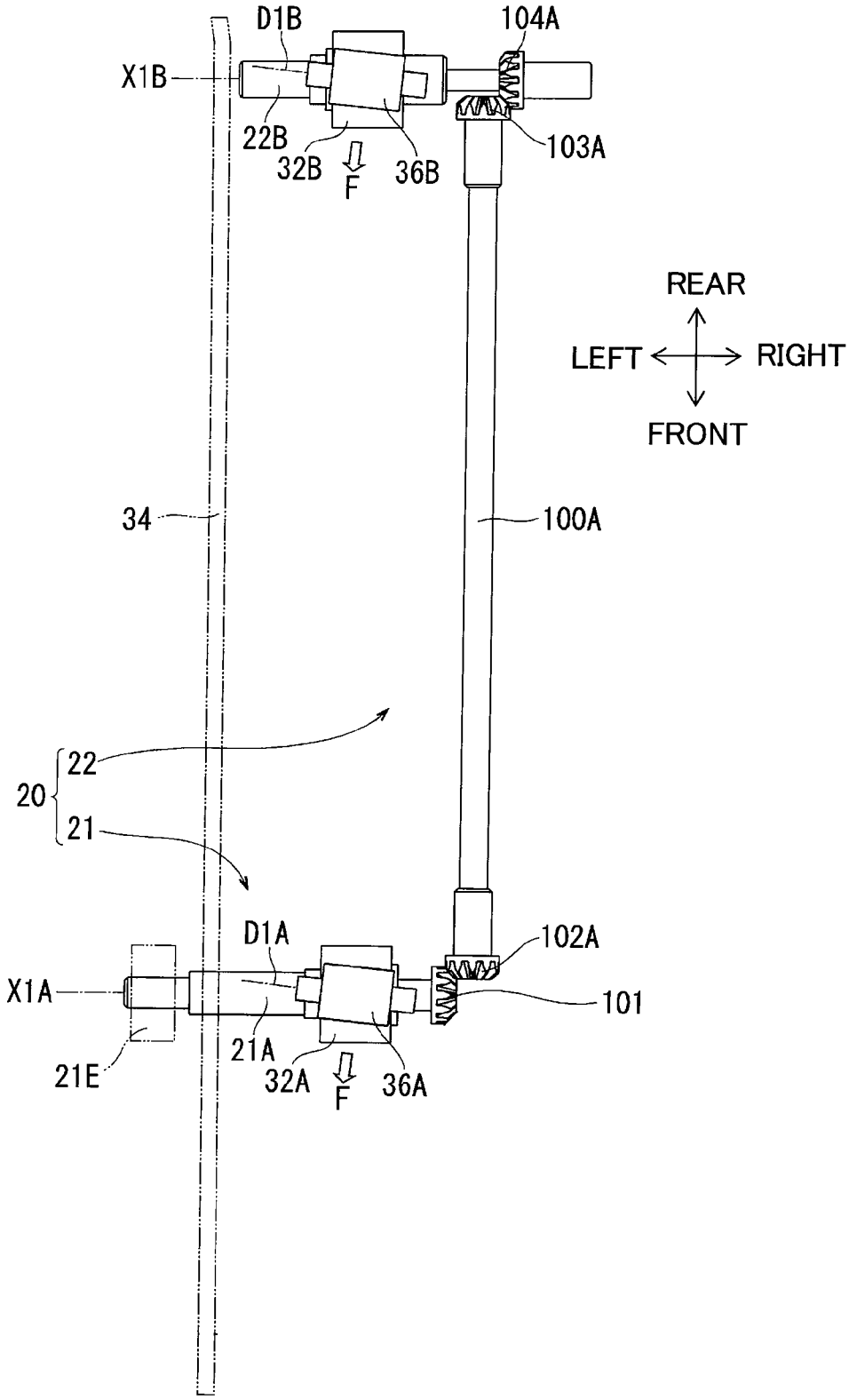
FIG. 12 is a top view showing the first transporting roller, the second transporting roller, the transmission mechanism, and the driven rollers of an image forming apparatus having one second transporting roller.

The present invention has been described by referring to the embodiments from the first embodiment to the fifth embodiment. However the present invention is not restricted to the embodiments from the first embodiment to the fifth embodiment, and it is needless to mention that the present invention is also applicable to various modifications which fairly fall within the basic teachings herein set forth. For example, the number and arrangement of the first transporting roller and the second transporting rollers are not restricted to the number and the arrangement described in the embodiments from the first embodiment to the fifth embodiment, and may be set arbitrarily. For example, one second transporting roller may be provided at an upstream side of the first transporting roller 32A as shown in FIG. 12. Although it is not shown in the diagram, one second transporting roller may be provided at a downstream side of the first transporting roller 32A. In any of the cases, as compared to the printers described in the embodiments from the first embodiment to the fifth embodiment, it is possible to realize further reduction of the number of components and reduction of size of an apparatus.

It is possible to use the present invention in an image forming apparatus. The present invention is not restricted to an image forming apparatus having only a printer function as mentioned above. The present invention is also applicable to a multi-function device which also has functions such as a facsimile function and a copy function.

What is claimed is:

1. An image forming apparatus which forms an image on a medium, comprising:

an image forming section which carries out formation of the image on the medium which is transported;

a reverse section which reverses the medium passed through the image forming section; and a re-transporting section which transports the medium, reversed by the reverse section, again to the image forming section, the re-transporting section comprising:

a re-transporting path extending from the reverse section to the image forming section, a drive mechanism which generates a driving force for transporting the medium, a first transporting roller which is connected to the drive mechanism to transport the medium, a second transporting roller which transports the medium in cooperation with the first transporting roller, a first transmitting section having a first gear which is coaxially coupled with the first transporting roller so that the first gear is rotatable integrally with the first transporting roller, and transmitting the driving force of the drive mechanism to the first transporting roller, and a second transmitting section having: a second gear which is engaged with the first gear; a shaft which is extended in a direction intersecting a rotational axis of the first transporting roller and a rotational axis of the second transporting roller, and which is coaxially coupled with the second gear so that the shaft is rotatable integrally with the second gear; a third gear which is coaxially coupled with the shaft so that the third gear is rotatable integrally with the shaft; and a fourth gear which is engaged with the third gear and which is coaxially coupled with the second transporting roller so that the fourth gear is rotatable integrally with the second transporting roller, the second transmitting section transmitting the driving force transmitted to the first transmitting section to the second transporting roller;

wherein the shaft includes at least two divided portions, the first transmitting section is arranged at an connecting portion of the divided portions of the shaft, the second transmitting section is arranged to sandwich the first transmitting section, and the first gear of the first transmitting section and the fourth gear of the second transmitting section are arranged to face with each other so that the first and fourth gears sandwich the rotational axis of the shaft.

2. The image forming apparatus according to claim 1, wherein the second transporting roller and the third gear are formed as a plurality of second transporting rollers and a plurality of third gears, respectively;

the second transporting rollers are positioned at an upstream side and a downstream side respectively, of the re-transporting path, with respect to the first transporting roller; and the shaft has the second gear at one end portion thereof and has the third gears at an intermediate portion and the other end portion thereof respectively.

3. The image forming apparatus according to claim 1, wherein the second transporting roller is formed as a plurality of second transporting rollers; and the second transporting rollers are positioned at an upstream side and a downstream side respectively, of the re-transporting path, with respect to the first transporting roller.

4. The image forming apparatus according to claim 3, wherein the third gear is formed as a plurality of third gears; and the shaft has a first shaft and a second shaft, the first shaft extending toward the upstream side of the re-transporting path with respect to the first transporting roller and having the second gear at one end portion of the first shaft and having one of the third gears at an intermediate portion or other end portion of the first shaft, the second shaft extending toward the downstream side of the re-transporting path with respect to the first transporting roller and having the second gear at one end portion of the second shaft and having one of the third gears at an intermediate portion or the other end portion of the second shaft.

5. The image forming apparatus according to claim 1, wherein the first gear and the second gear are crown gears, and the third gear and the fourth gear are spur gears.

6. The image forming apparatus according to claim 1, wherein the first gear and the second gear are spur gears, and the third gear and the fourth gear are crown gears.

7. The image forming apparatus according to claim 1, wherein the first gear, the second gear, the third gear, and the fourth gear are bevel gears.

8. The image forming apparatus according to claim 1, wherein the re-transporting section includes a plurality of driven rollers which face the first transporting roller and the second transporting rollers respectively, and which transport the medium by pinching the medium together with the first and second transporting rollers;

the rotational axes of the first and second transporting rollers are orthogonal with respect to the re-transporting path; and rotational axes of the driven rollers are each inclined with respect to a direction which is orthogonal to the re-transporting path.

9. The image forming apparatus according to claim 7, wherein the rotational axes of the first and second transporting rollers are inclined with respect to a direction orthogonal to the re-transporting path.

10. The image forming apparatus according to claim 9, wherein the re-transporting path includes a plurality of driven rollers which face the first transporting roller and the second transporting roller respectively, and which transport the medium by pinching the medium together with the first and second transporting rollers.

11. The image forming apparatus according to claim 1, wherein the image forming section comprises:

a photosensitive drum having a photosensitive body provided on a surface thereof;

a scanner section which has a light source and a lens, and which forms an electrostatic latent image on the photosensitive body on the surface of the photosensitive drum by irradiating light from the light source to the photosensitive drum;

a developing section which has a developer which develops the electrostatic latent image; and a transfer section which has a pressurizing roller and a heating roller arranged to face each other, and which transfers a developed image to the medium.

12. The image forming apparatus according to claim 8, wherein a rib with which the medium is brought into contact is formed in the re-transporting path at an end portion in a width direction, of the re-transporting path, orthogonal to an extending direction of the re-transporting path; and a direction orthogonal to the rotational axes of the driven rollers are inclined toward the rib, with respect to a transporting direction in which the medium advances while being transported.

13. The image forming apparatus according to claim 10, wherein a rib with which the medium is brought into contact is formed at an end portion in width direction, of the re-transporting path, orthogonal to an extending direction of the re-transporting path; and a direction orthogonal to the rotational axes of the first and second transporting rollers and the rotational axes of the driven rollers are each inclined toward the rib, with respect to a transporting direction in which the medium advances while being transported.

14. The image forming apparatus according to claim 3, wherein the second transporting roller is formed as two second transporting rollers, and the two second transporting rollers are positioned at an upstream side and a downstream side respectively, of the re-transporting path, with respect to the first transporting roller.

15. The image forming apparatus according to claim 1, wherein the second transporting roller is formed as one second transporting roller; and the one second transporting roller is positioned only at an upstream side or a downstream side, of the re-transporting path, with respect to the first transporting roller.

16. The image forming apparatus according to claim 1, wherein the rotational axes of the first and second transporting rollers intersect with a drawing direction of the re-transporting section along which the medium is transported in the re-transporting section.

* * * * *